United States Patent [19]

Jeswine

[11] 4,100,687

[45] Jul. 18, 1978

[54] VERTICAL AUGER SNOW REMOVAL DEVICE

[76] Inventor: Adolph Jeswine, 735 8th Ave., Helena, Mont. 59601

[21] Appl. No.: 720,408

[22] Filed: Sep. 3, 1976

[51] Int. Cl.[2] ..... E01H 5/00

[52] U.S. Cl. ..... 37/43 K

[58] Field of Search ..... 37/43 K, 43 A, 43 R, 37/26, 27

[56] References Cited

U.S. PATENT DOCUMENTS

| | | | |
|---|---|---|---|
| 707,121 | 8/1902 | Kryger | 37/27 |
| 1,593,523 | 7/1926 | Wright | 37/43 K |

FOREIGN PATENT DOCUMENTS

| | | | |
|---|---|---|---|
| 164,901 | 12/1949 | Austria | 37/43 R |
| 185,080 | 7/1936 | Switzerland | 37/43 K |

*Primary Examiner*—E. H. Eickholm

[57] ABSTRACT

A vertical augered snow removal device in which the augers rotate, in unison, toward the fan opening, at the center, back of the augers; which lift and throw the snow through the fan opening to the ejection device or rotor fan mounted behind the augers.

The augers are arranged in side by side, relation to each other; two pairs of twin augers mounted at each half of the frontal area, rotating in unison toward the fan opening, at the center; the outer augers feeding the snow to the inner augers which actually throw the snow, rearwardly, in a common tangent, through the fan opening, into the rotor fan.

The open sides or ends, permit maneuveribility into the snow banks at the sides when the device is moved parallel to the highway in snow removal operations on snow banks, which can readily be removed with a rotary, which breaks up the snow sufficiently, in order to feed the snow to the fan.

The augers on one side of the rotary have a helical pitch or slope opposite from the augers on the other side. More specifically, the augers on the right side have a right hand pitch with a left hand slope, whereas the augers on the left side have a left hand pitch with a right hand slope, looking at the augers from the front. This arrangement will move the snow very rapidly, (actually throw the snow) through the fan opening, at 200 cu. ft./sec. (snow at 10 lbs./cu. ft.) or 3600 tons of snow per hour; using the same engine used on present rotary design, for the 8 ft. swath. (See widening the scope of my invention, for the 10 ft. swath).

3 Claims, 3 Drawing Figures

VERTICAL AUGER SNOW REMOVAL DEVICE

SUMMARY OF MY INVENTION

Figure 1:
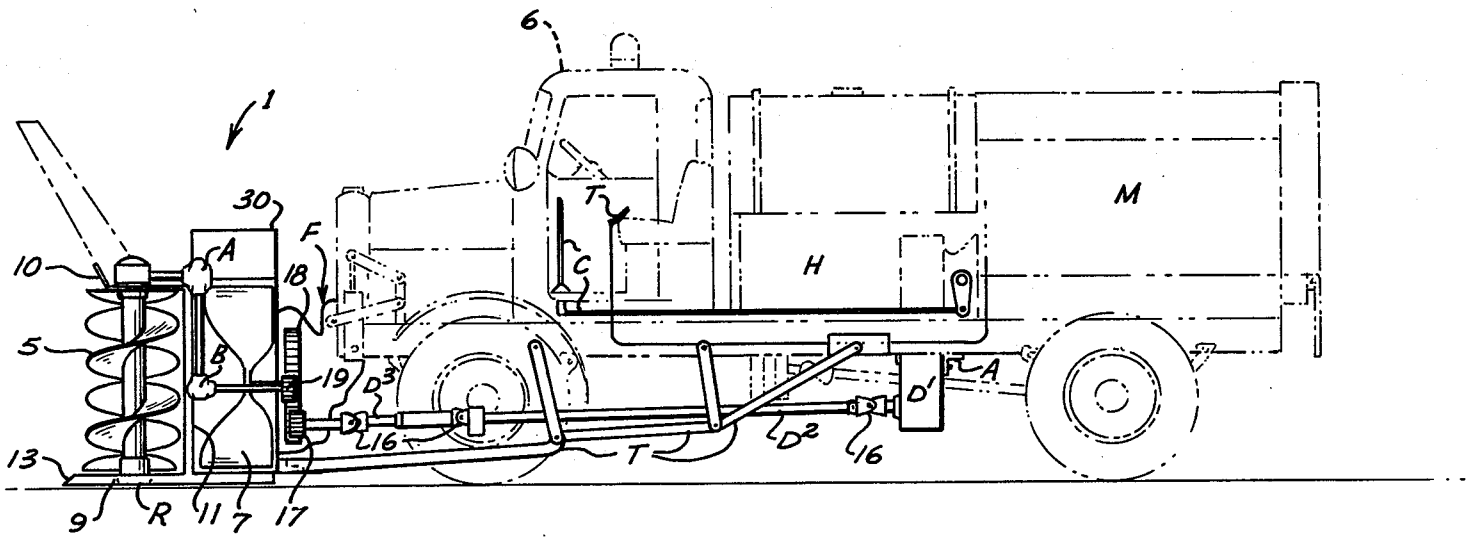

Manufacturers are looking for a better rotary than Klauer's rotary; which has outperformed all other rotaries for many years but has fallen short of the ideal of the performance necessary on the new Interstate Highways, designed for greater speed and safety for the cars and trucks driving at higher speeds. The new jets flying at supersonic speeds, which require longer and wider runways.

The object of my invention is not only to increase the flow of the snow through the fan opening, but also, to move the snow, in in shortest circuit possible, of the snow from the augers to the fan.

My invention, which can easily be incorporated in present rotary designs, would fully utilize the potential latent, in present rotary design, which is not possible, in present rotary design, which exploits the augers mounted on a horizontal axis.

My invention would exploit the augers mounted on a vertical axis, in order to prevent, not only, the clogging of the snow in the auger flights, at the fan opening but also, prevent the unequal thrust developed, by the augers, from the sides, which can cause zig zagging at the front wheels, when the lateral thrust is unequal, which occurs when the augers are mounted on a horizontal axis.

My invention would triple the flow of the snow through the fan opening, to 200 cu. ft./sec., or 3600 tons of snow per hour for the 8 foot swath. Widening the swath to 10 feet would increase the flow of the snow to 300 cu. ft./sec. or 5400 tons of snow per hour, for a really high performance rotary!

My invention mounted on the front of the (F.W.D.) truck would be ideally suited, using front wheel drive, for snow removal operations, rear wheels, for faster moving of the truck, when the rotary is lifted and carried on the unitary frame, on the front of the truck.

WIDENING THE SCOPE OF MY INVENTION

1. Widening the swath to 10 feet, mounting larger augers (vertically) 4 (2½ ft. D × 5 ft. H) with a (5 feet × 2 feet W) rotor fan, using the same size C.I.D. engine (Deisel) would increase the flow of the snow to 300 cu. ft. per sec. or 5400 tons of snow per hour for unprecedented performance for a really high performance rotary!

2. Narrowing the swath to six feet, mounting two augers (3 feet D × 4 feet H) with a (4 feet D) rotor fan; for mounting on the front of a chassis, with the huge engine mounted at the rear, for driving the chassis, (multiple gear box) and turning the augers and fan simultaneously; for fast loading of the snow from streets, (using the arced loading chute) for compacting the snow, into trucks for hauling to dump areas. Advantage: With the huge engine mounted at the rear, would enable the driver to better see the snow loading operation at the front.

3. Use of two very large augers mounted on the front of a RR locomotive together with a very large rotor fan, for clearing the snow from railroad tracks with open bottoms for the augers, for sucking up the loose snow between the rails.

4. Use of augers and fans of various sizes for mounting on the front of a small tractor, with P.T.O. for turning the augers and fan.

5. Use of smaller augers, feeding the snow to a rotatable discharge spout for home use on sidewalks and driveways, using a 1 cylinder motor, or electric motor for power to sell at a low price.

VERTICAL AUGER SNOW ROTARY

This invention relates generally to snow rotaries and particularly to the snow gathering or feeding mechanism, that can readily be mounted on the front of a truck and powered to feed the snow to a snow discharging device or rotor fan which hurls the snow to either side, as desired.

The difficulty most likely encountered in rotary design, is the snow feeding mechanism, which contacts the snow banks of varying depths and density, which must be broken sufficiently, in order to feed the snow to the rotor fan.

The snow feeding mechanism is of vital importance in rotary design as it, not only, produces the flow of snow to the rotor fan, but also, determines the performance of the rotary.

The function of the snow feeding mechanism is to break up the snow on the larger oblong area at the front, and feed the snow to the smaller circular area at the fan opening in order to feed the snow to the rotor fan at the center.

The well known auger has proved to be the best device for breaking down the snow banks. The trend in present rotary design to mount the augers on a horizontal axis.

U.S. Pat. No. 2,144,311 to Klauer, which mounts three rows of augers on horizontal axes for mounting on the front of a truck; is widely used in snow removal operations on highways; on runways for airports, (equipped with arced loading chute) for loading the snow into trucks, for hauling to dump areas.

This arrangement was not entirely satisfactory when heavy wet snow was encountered; clogging or packing of the snow in the auger flights occurred at the fan opening, and the following improvements were tentatively tried with varying success.

U.S. Pat. No. 2,144,316 to Klauer, for modifying the augers and devices for breaking down the congested snow at the fan opening.

U.S. Pat. No. 2,285,162 to Klauer, for sloping the walls back of the augers, to allow the augers to unload their entire length, (heretofore restricted to the fan opening.)

This arrangement is logical on the assumption that the augers unload the snow rearwardly (as Klauer intended); but rather invariably unload prematurely at the tangent point to the next lower auger until the bottom auger is reached where the snow is fed laterally toward the fan opening where the fan suction is strongest in order to lift the snow through the fan opening into the fan, which hurls the snow to either side as desired. Obviously, the snow gathers in front of the fan opening; and when undue stress is applied, bending the auger is likely to occur, (being unsupported at the center), when the auger must be straightened or replaced.

If the downward trek of the snow could be diverted horizontally, the above difficulty could be eliminated.

I have discovered that the flow of the snow is primarily in the direction of the rotation of the augers, that the augers impart both a radial and lateral movement ot the snow; the radial movement being the dominant one, regardless of the depth of the snow.

It would, therefore, be necessary and logical to remount the augers on a vertical axis rather than horizontal as Klauer and others have done, in order to divert the flow of the snow toward the fan opening.

I would mount larger augers of only half the length that Klauer uses, mounting two pairs of twin augers (vertically) of opposite pitch at each half of the oblong frontal area, in order to break up the snow banks, at the sides, beyond the fan area; the outer augers feeding the snow to the inner augers which unload the snow directly in front of the fan opening, in order to feed the snow more effectively to the fan at the center.

This arrangement should increase the flow of the snow to the fan, much more than is possible in Klauer's arrangement which utilizes only a small portion of the auger capacity at 67 cu. ft./sec. (snow 10 lbs./cu.ft.) or 1200 tons of snow per hour, for the 8 ft. swath.

Using a much larger fan, in order to balance the auger and fan capacities, would triple Klauer's output for my invention, to 200 cu.ft./sec. or 3600 tons of snow per hour, for unprecedented performance for a H.P. rotary (using the same engine and underslung drive mechanism that Klauer uses. (See widening of the scope sheet for 10 ft. swath.)

Numerous other features and advantages of the auger mounted vertically will become apparent referring to the drawings which form a part of this application.

FIG. 1, left side view of the rotary 1 mounted on the front of the truck, showing the motor M, mounted at the rear. The underslung drive mechanism $D^1$, brought below and forward $D^2$, flexibly mounted on the front axle of the truck, $D^3$ for turning the augers 2, 3 - 4, 5 and fan 7, simultaneously; the beveled gear housings, A and B, the pinion 17 meshing with ring gear 18 (coupled to fan 7).

Figure 2:
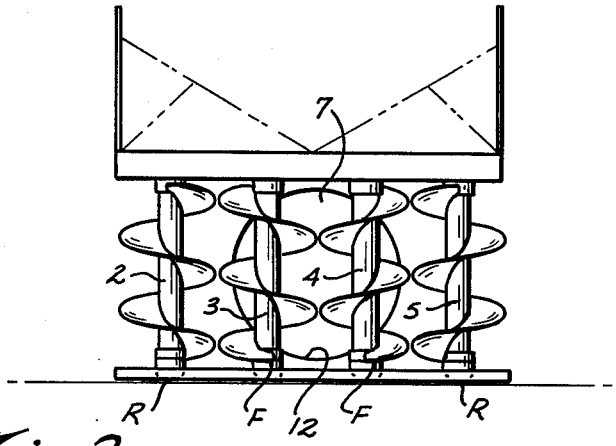

FIG. 2, Front view of the augers 2, 3 and 4, 5 showing relative sloping geometrical relationship, of the auger blades; to enable the outer augers 2, 5, (full of snow) to feed the snow to the (empty) inner augers 3, 4 which unload the snow directly in front of the fan opening 12, in order to feed the snow, in the shortest circuit possible of the snow from the augers to the fan.

Figure 3:
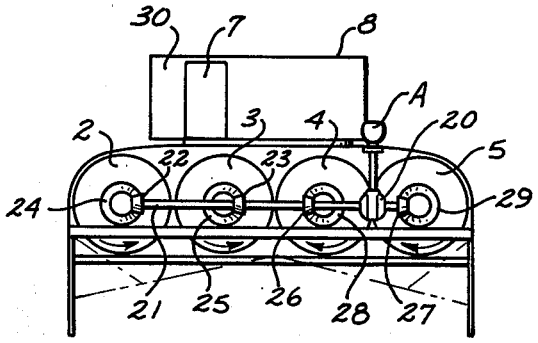

FIG. 3, Top plan view of the enclosed drive mechanisms for the augers 2, 3 - 4, 5: the shaft 21, mounting pinions 22, 23 meshing with ring gears 24 and 25 for counter clockwise rotation of the augers 2 and 3; pinions 26, 27 meshing with the ring gears 28, 29 for clockwise rotation of augers 4 and 5. (See arrows). The right angle drive unit 20, for turning shaft 21, enclosed bevel gears in housings A and B, see (FIG. 1).

NOTE: I have shown my invention mounted similar to Klauer's rotary, using the same type of underslung drive mechanisms; hydraulic lift mechanisms, cutter bars for cutting over hanging snow banks; thrust mechanisms, which are adaptable to any type of truck, in order to illustrate the adaptability of my invention, which can easily be incorporated on present rotary design.

While the vertical auger arrangement shown mounted on the front of a truck, it is to be appreciated and understood that a smaller version for mounting on the front of a small tractor or smaller powered unit for home use on sidewalks and driveways, is also within the scope of this invention. In addition, a much larger version, for mounting on the front of a RR locomotive, for clearing railroad tracks. (see widening the scope of my invention.)

Referring now to the drawings in detail specifically to FIG. 1, there is shown the improved rotary of this invention.

Snow plow or rotary 1, shown mounted on the front of a truck 6, showing the two pairs of twin augers (mounted on vertical axes) at each half of the frontal area, the outer augers (2 and 5) FIG. 2, rotating inwardly (full of snow) unload the snow to the (empty) inner augers (3 and 4) which unload the snow directly in front of the fan opening, actually throw the snow through the fan opening 12 (FIG. 2) in order to feed the snow to the fan 7 (FIG. 1).

The augers are mounted in a housing, open at the front and sides; having the circular opening to the fan, at rear center 11 (rear); 10 (top), 9 (bottom), the lower lip 13, (FIG. 1) for mounting the H.C. scraper blade, bolted to the lip, for scraping the snow down to the pavement the full width; the scraper being adjustable and easily replaced when necessary.

The upper ends of the augers, are mounted on ball bearings, bolted on the underside of 10, (FIG. 1, 2); the bottom ends of the augers are mounted in tapered roller bearings bolted to upper side of 9, (FIG. 1, 2).

The augers are readily replaceable and have a heavily reinforced helical flange, F, collared to bottom of all four augers, to prevent the bottom edge of the augers from scraping the bottom plate 9 (FIG. 2).

The fan housing 8, mounted behind the augers, rotatable with a horizontally mounted hydraulic ram, (not shown), linked to the fan housing, controllable from the cab of the truck, 6.

The augers are driven by ring gears 24, 25 - 28, 29 meshing with pinions 22, 23 - 26, 27 mounted on counter shaft 21, the gears are enclosed in oil tight housings, with removable covers, (shown removed).

The right angle drive gears for turning shaft 21, enclosed in housing 20, the drive brought up from below, by the sturdy bevel gears, in housing A and B, FIG. 1; pinion 19, meshing with ring gear 18, coupled to the rotor fan 7, which hurls the snow through the tangential discharge spout 30.

The (long extended) underslung drive mechanism from engine M, mounted at the rear of the truck, (3 pt. suspension); with the enclosed drive mechanism $D^1$, for bringing the drive below and brought forward $D^2$, mounted (flexibly) on the front axle of the truck, $D^3$ for driving the augers and turning the fan, universal joints 16, two at front, one at the rear to allow for the up and down movement of the springs of the truck. (FIG. 1).

The underslung thrust mechanism T, for the thrust at the front on the rotary, for transmitting the thrust to the sides of the frame of the truck. (FIG. 1).

The clutch control C., (FIG. 1) in the cab of the truck, the throttle level T, for the cable for controlling the engine M, speed; (FIG. 1) the hydraulic pump mechanism enclosed in housing H, for lifting the rotary and carrying it on the unitary frame F, (FIG. 1) all controllable from the cab 6.

The angle iron A. bolted to the frame of the truck for angular adjustment of housing $D^1$ (FIG. 1).

The helical blades of the augers 2 and 3 are identical and have left hand helix and right hand slope.

The helical blades of augers 4 and 5 are identical and have right hand helix and left hand slope.

With reference to FIG. 3 it will be apparent that augers 4 and 5 rotate in a clockwise direction as viewed from above and that augers 2 and 3 rotate in counter clockwise direction as viewed from above. (See arrows).

Reference to FIG. 3, each of the augers rotate in a direction such that the front portions of the auger blades move toward the centrally located fan opening 12, to fan 7, located behind the augers.

The snow is loosened and thrown through the fan opening 12, into fan 7, in discharged by the rapidly rotating fan through the tangential discharge spout 30, in fan housing 8. Advantageously, a fan 7, with 4 ft. diameter is driven to rotate at a speed of 360 rpm. This speed is found to be sufficient to hurl the snow, out of deep cuts in mountainous terrain, dispersing the windrowed snow on airport runways, up to 200 feet. In addition, augers 2, 3 - 4, 5 having a diameter of 2 ft., each rotating at a speed of 300 rpm, a speed sufficient to break up heavily drifted packed snow banks, in order to feed the snow to the rotor fan, at the center.

Augers 2, 3 - 4, 5 perform the dual function of breaking up the snow on the larger oblong frontal area and feeding the snow, to the smaller, circular area of the fan opening. With reference to FIG. 2, it will be observed that each auger blade is a 2½ turn helix. Such a 2½ turn helix for each auger is 2 ft. in diameter and 4 feet high, turning in unison, for balanced and smooth operation of the augers, essential for continual operation of the rotary. Similar proportions can be used in larger or smaller apparatus. (See widening the scope of my invention for 10 ft. swath.)

As previously explained, augers 2 and 3, each have left hand helical blades, whereas augers 4 and 5 each have a right hand helical blades. The blades are each of the same pitch or lead and are each of the same diameter.

The advantages of and the operation of the augers will now be explained. With reference to FIG. 2, it will be noted that the front portions of the blades of augers 2 and 3 slope toward the fan opening at the center; the front portions of the blades of augers 4 and 5 slope opposite toward the center of the rotary along common planes. In addition, augers 2 and 3 rotate, and augers 4 and 5 rotate towards a common center, namely, the fan opening. Hence, snow, engaged by the auger 2 is fed, centrifugally, toward auger 3 and snow engaged by 5, is fed centrifugally, to auger 4. It will be observed with reference to FIG. 2, that the auger blades slope, at the front toward the fan opening 12, by virtue of this arrangement, the rotation of the outer augers (2 and 5) feeds the snow, to the inner augers (3 and 4), is lifted and both slides and is thrown rearwardly through the fan opening 12, into the fan 7. This occurs because of the speed of the rotation of the augers, namely, 300 rpm, which provides a combined conveying and throwing action on the snow.

The auger drive, including shaft 21 and the ring gears 24, 25 - 28, 29 rotate all the augers at the same speed, hence, the rotational alignment between the blades of the various augers remain the same during rotation of the augers, the relationship will always exist because the blades are rotated at the same synchronized speed.

An additional advantageous feature of this invention is that the sides of the auger housing is open at the sides or ends, to expose the outer augers 2 and 5. This permits lateral manuevering into the snow banks at the sides, (left by the blade plows), which can readily be removed by a rotary; or for widening of the swath through the snow, the augers, cutting into snow banks do not swurve the truck off its course, like the augers mounted horizontally do; when it becomes necessary to use rudders with adjustable angles of incidence to guide the rotary through the snow. (See U.S. Pat. No. 1,889,667 to Klauer).

By virtue of this arrangement shown and described herein, the flow of the snow to the fan 7, occurs at a tremendous rate. It has been found that the augers of the size and proportions previously explained, snow can be removed at the rate of 200 cu. ft. per second. This amounts to 3600 tons of snow per hour for the 8 ft. swath where the snow has a density of 10 pounds per cu. ft. (See widening sheet for the 10 ft. swath).

While a preferred embodiment of the snow removal devise has been shown and described in detail, it is to be understood that numerous changes can be made without departing from the scope of the invention as explained herein and set forth in the appended claims. (See widening the scope sheet for the 10 ft. swath).

What is claimed is:

1. A snow removal device comprising, in combination, a snow blower fan having a horizontal axis, a first vertical auger at one side of the fan axis and in front of the fan, a second vertical auger beside the first auger, at the other side of the fan axis and in front of the fan, said first auger having a continuous right hand helix blade originating near the bottom of the auger and ending near the top of the auger, means said second auger having a continuous left-hand helix blade originating near the bottom of said second auger and ending near the top of said second auger mounting said augers for rotation about parallel vertical axes with said right hand helix auger to the right of the fan centerline, as viewed from in front of the augers and looking toward the fan, and said left hand helix auger to the left of the fan centerline, as viewed from in front of the augers and looking toward the fan, so that the front portions of the blades of the augers slope toward each other, drive means for rotating the augers in synchronism toward each other so that said front portions of the blades which slope toward each other convey snow toward the vertical plane including the fan axis, said fan having a diameter approximately equal to the height of each auger and having its axis disposed in a generally horizontal plane mid-way between the ends of the augers so that all snow conveyed toward the fan by the augers is removed by the fan without danger of clogging in the region between the fan and the augers, and further comprising, third and fourth vertical augers in a common horizontal plane with said first and second augers, means mounting said third auger beside said first auger, and means mounting said fourth auger beside said second auger, said third auger being identical to said first auger, and said fourth auger being identical to aid second auger, and drive means for rotating said first and third augers in the same direction and toward the fan and for rotating the second and fourth augers in the same direction and toward the fan, said drive means including positive gearing for rotating said augers at the same speed and in synchronism, said auger blades of the first and third augers being essentially tangent to each other at two locations, and said auger blades of said second and fourth augers being essentially tangent to each other at two locations, to provide inwardly sloping continuous blade surfaces across the two augers at each side of the fan axis, said essentially tangent surfaces causing snow to slide toward the vertical plane of the fan axis in a continuous fashion, said drive means for rotating the augers in synchronism maintaining said essentially tangent relationship for all rotational positions of said augers.

2. A snow removal device according to claim 1 wherein each auger has a diameter equal to about one-half its height, and the entire region to the front and sides of the augers is open and unobstructed to permit removal of accumulated snow from roadsides with one of the third and fourth augers, and in a direction oblique to the plane of the auger axes.

3. A snow removal device according to claim 1 wherein said augers and said fan cooperate to provide means for removing snow at rates as high as 5400 tons per hour.

* * * * *